US006786564B2

(12) United States Patent
Morikawa

(10) Patent No.: US 6,786,564 B2
(45) Date of Patent: Sep. 7, 2004

(54) INKJET PRINTER, DRIVE METHOD AND DRIVE DEVICE FOR SAME

(75) Inventor: Yukio Morikawa, Minato (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 10/253,507

(22) Filed: Sep. 25, 2002

(65) Prior Publication Data

US 2003/0020772 A1 Jan. 30, 2003

Related U.S. Application Data

(63) Continuation of application No. PCT/JP00/02136, filed on Mar. 31, 2000.

(51) Int. Cl.[7] ..... B41J 29/38
(52) U.S. Cl. ..... 347/10; 347/9; 347/11
(58) Field of Search ..... 347/10, 9, 11

(56) References Cited

U.S. PATENT DOCUMENTS 6,151,050 A * 11/2000 Hosono et al. ..... 347/70
6,419,337 B2 * 7/2002 Sayama ..... 347/11
6,523,923 B2 * 2/2003 Sekiguchi ..... 347/11

FOREIGN PATENT DOCUMENTS

EP 0 827 838 A2 3/1998
JP 8-336970 12/1996
JP 10-138475 5/1998
JP 11-78005 3/1999
JP 11-277736 10/1999

* cited by examiner

*Primary Examiner*—Stephen D. Meler
*Assistant Examiner*—Alfred Dudding
(74) *Attorney, Agent, or Firm*—Armstrong, Kratz, Quintos, Hanson & Brooks, LLP

(57) ABSTRACT

An inkjet printer for recording dot patterns corresponding to image contents is disclosed. The printer comprises an inkjet head (51) for performing recording by moving in a main scanning direction of a recording medium and injecting ink particles, drive waveform generating sections (24, 25) for generating drive waveforms for injecting said ink particles, and a head drive section (50) for selecting said drive waveforms and driving said inkjet head (51) in accordance with print data. The drive waveform generating sections (24, 25) generate drive waveforms for injecting said ink particles having different ink speeds within a unit cycle, in cycles each corresponding to one of the parts obtained by dividing the unit cycle by an integer. Thereby, by varying the speed of the ink particles injected in one cycle of the drive waveforms, the landing position of each dot in the cycle is controlled and hence the dot pattern in one cycle is varied. Since this is achieved by means of the drive waveforms, it can be implemented without changing the image data.

24 Claims, 13 Drawing Sheets

INKJET PRINTER, DRIVE METHOD AND DRIVE DEVICE FOR SAME

This application is a continuation of international application PCT/JP00/02136, filed Mar. 31, 2000.

TECHNICAL FIELD

The present invention relates to an inkjet printer which injects ink particles in accordance with a drive waveform, and a drive method and drive device for same, and more particularly, an inkjet printer, and drive method and drive device for same, whereby a plurality of drive patterns are generated by combining drive waveforms within a single cycle.

BACKGROUND ART

Inkjet printers are used in recording devices for text, images, and the like, such as printers, copying machines, facsimile machines, and the like. Print data from a host PC is sent to the control section of an inkjet printer, and this control section sends waveform data (DRV), waveform selection data (SDATA), and the like, to a head drive section on a head carrier, and ink is injected from an ink jet head.

In such an inkjet printer, the size of the injected ink particle can be changed by means of the drive waveform. Therefore, if it is required to represent print density in an image, recording is performed by injecting several ink particles of different sizes from the same inkjet nozzle. The prior art is now described with reference to FIG. 12 and FIG. 13.

FIG. 12 is a compositional diagram of a conventional inkjet head drive circuit, and FIG. 13 is an illustrative diagram of a drive waveform thereof. As shown in FIG. 12, drive generators 94, 95, 96, 97 are provided in equal number to the number of types of ink size (in this diagram, there are four such types,) and these drive generators 94–97 are driven simultaneously. And a drive waveform for injecting a desired ink particle is selected by a waveform selector section 92, and the nozzle of the ink jet head 93 is driven.

In this method, only four types of waveform can be generated. However, as shown in FIG. 13(A), one cycle is divided into 5 parts, and drive source 94 generates a waveform of waveform number '0' wherein no ink particle is generated, whilst the drive sources 95, 96, 97 generate waveforms of waveform numbers '1', '2', '3' wherein an ink particle is generated.

Here, waveform number '1' is a waveform for generating a micro-particle by the waveform of one part of the divided time period, whereas if waveform numbers '2', '3' are selected in sequence, then a waveform for generating a small particle in two parts of the divided time period is obtained. This waveforms are generated by each of the waveform generators in sequence from the left-hand side. Thereupon, when the input data is divided into data for respective cycles, and supposing that the divided data for one cycle has the waveform number '01010', it is possible to obtain the waveform shown in FIG. 13(B), and hence a waveform for generating two micro-particles can be generated.

If it is supposed that a waveform number '12323' is generated by the controller 90, then the waveform shown in FIG. 13(C) can be obtained, and hence a waveform for injecting one micro-particle and two small particles is injected.

Thereby, by using four waveform generators, it is possible to generate a greater number of types of waveforms, and hence a print pattern having a large number of surface area tone gradations can be achieved by means of a small number of waveform generators.

In the prior art, the landing positions at which the dots are situated are determined by the print timing at which they are injected within one cycle of the drive waveform. Therefore, a problem results in that the print pattern in one cycle is fixed. In particular, when printing images, it is desirable to change the printing pattern in accordance with the content of the image, but in order to achieve this, it is necessary to change the image data.

DISCLOSURE OF THE INVENTION

It is an object of the present invention to provide an inkjet printer, and a drive method and drive device for same, for controlling the landing positions of the respective dots in one cycle, and thereby changing the print pattern for one cycle.

It is a further object of the present invention to provide an inkjet printer, and a drive method and drive device for same, for changing the print pattern in one cycle, without changing the print data.

It is yet a further object of the present invention to provide an inkjet printer, and a drive method and drive device for same for printing an optimum print pattern in accordance with the image contents.

In order to achieve these objects, the inkjet printer according to the present invention includes: an inkjet head which performs recording by moving in a main scanning direction of a recording medium and jetting ink particles; a drive waveform generating unit for generating drive waveforms for jetting the ink particles; and a head drive unit for selecting the drive waveforms and driving the inkjet head, in accordance with print data. The drive waveform generating unit generates a drive waveform for jetting ink particles having respectively different ink speeds within a unit cycle, said one ink particle is jetted in cycles each corresponding to one of the parts obtained by dividing the unit cycle by an integer.

In the present invention, by changing the speed of the ink particles injected in one cycle of a drive waveform, the landing position of each dot in one cycle is controlled and the dot pattern within one cycle can be changed. Since this is achieved by means of the drive waveforms, it can be implemented without changing the image data. Therefore, when printing images having low-resolution surface area tone gradations, in particular, it is possible to obtain sharper images by concentrating the landing positions of the dots and hence raising the resolution, if an image of sharp variation of density is required. Furthermore, if an image of smooth variation of density, such as a photograph, is required, then a smoother image can be obtained by dispersing the landing positions of the dots.

Moreover, in the present invention, the drive waveform generating unit generates a plurality of drive waveforms for jetting the ink particles of respectively different ink speeds within the unit cycle, in order to achieve different ink particle volumes, and therefore the diameter of the dots can be controlled, and the print pattern can be changed further.

Moreover, in the present invention, the drive waveform generating unit selectively generates the drive waveform and a second drive waveform for jetting the ink particles having the same ink speed, within the unit cycle, and hence the print pattern within a cycle can be selected.

Furthermore, the present invention further includes a control unit for controlling the generation of the second drive waveform and the generation of the drive waveform by the drive waveform generating unit, in accordance with instructions from an external source or analysis of the print data, and therefore a print pattern corresponding to the image to be printed can be selected.

Moreover, in the present invention, the drive waveform generating unit generates drive waveforms of different waveform shapes, within the unit cycle, and therefore the present invention can be achieved readily by changing the waveform shape.

Furthermore, in the present invention, the drive waveform generating unit generates drive waveforms having different voltage changing ratio, within the unit cycle, and therefore the ink speed of the ink particles can be changed readily.

Moreover, in the present invention, the drive waveform generating unit generates drive waveforms for concentrating the landing positions of the plurality of injected ink particles, within the unit cycle, and therefore, a sharp print image can be achieved, even in the case of an image of low resolution.

Furthermore, in the present invention, the drive waveform generating unit generates drive waveforms for dispersing the landing positions of the plurality of injected ink particles, within the unit cycle, and therefore, a soft image print result, such as a photograph, can be obtained.

Further objects and embodiments of the present invention will become evident from the following description of the embodiments and the accompanying drawings.

BEST MODE FOR CARRYING OUT THE INVENTION

Below, the present invention is described sequentially with respect to an inkjet printer, a first embodiment, a second embodiment, a third embodiment, and a fourth embodiment.

(Inkjet Printer)

Figure 1:
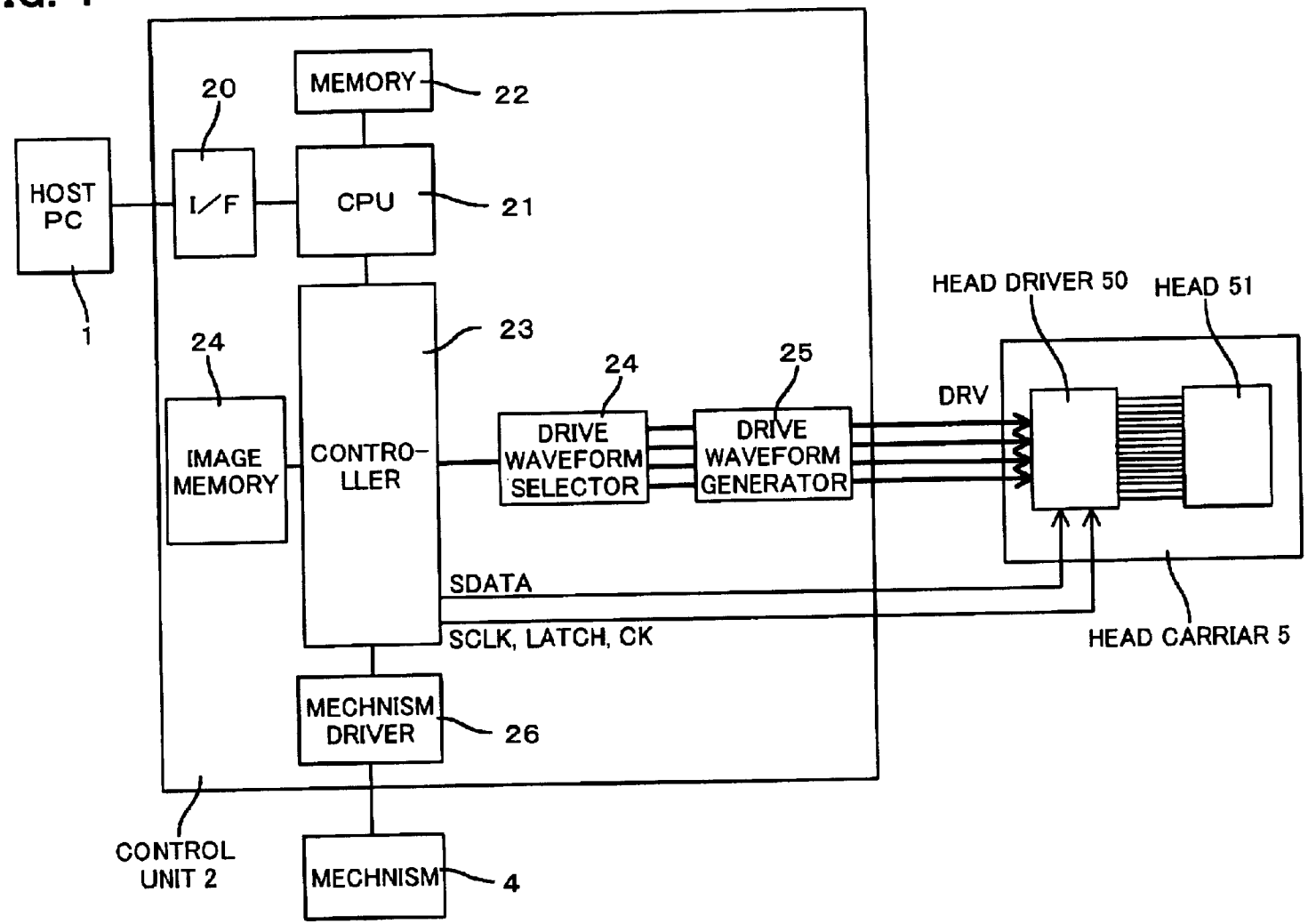
FIG. 1 is a compositional diagram of an inkjet printer according to one embodiment of the present invention.
Figure 2:
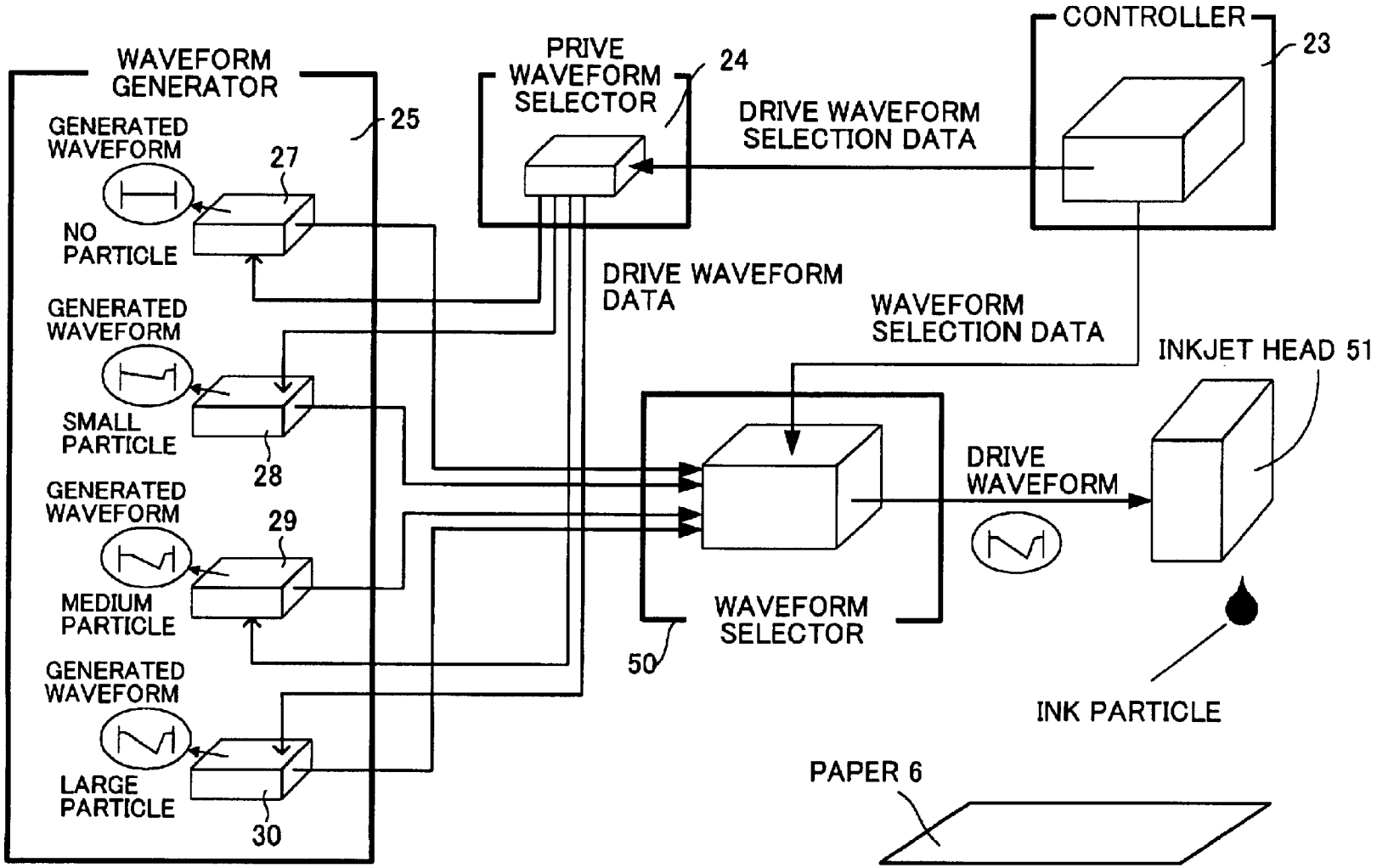
FIG. 2 is a compositional diagram of a drive waveform generating section in FIG. 1.

FIG. 1 is a compositional diagram of an inkjet printer according to one embodiment of the present invention, and FIG. 2 is a compositional diagram of a drive waveform generating unit in FIG. 1.

In FIG. 1, the host PC 1 sends print commands and print data to a control unit 2. A printer is constituted by the control unit 2, and a mechanism 4 and head carrier 5. The head carrier 5 consists of an inkjet head (hereinafter, called head) 51, and head drive unit 50. As illustrated in FIG. 2, the head 51 jets ink particles in accordance with a given drive waveform. For example, it is a piezoelectric type multi-nozzle head. The head drive unit 50 supplies a drive waveform to a selected nozzle. The mechanism 4 comprises a mechanism for moving the head carrier 5 in the main scanning direction of the recording medium 6, and a mechanism for conveying the recording medium 6 in a sub scanning direction.

The control unit 2 comprises an interface 20, CPU 21, memory 22, controller 23, waveform drive selector unit 24, drive waveform generator unit 25, and mechanism driver 26.

The interface 20 performs exchange of commands and data with the host 1. The CPU 21 performs principal control using the memory 22. The controller 23 controls the mechanism driver 26, and also outputs waveform selection data (print data SDATA, system clock SCLK, latch LATCH, clock CK) to the head drive unit 50, in accordance with the image data from the image memory 24. The controller 23 also outputs drive waveform selection data to the drive waveform selector unit 24, in accordance with image data or external instructions.

As shown in FIG. 2, the drive waveform generator unit 25 comprises four waveform generator sections 27 to 30. These respective drive waveform generator sections 27 to 30 respectively generate drive waveforms for producing no ink particle, a small ink particle, a medium ink particle, and a large ink particle. The respective drive waveform generator sections 27 to 30 each generate one of two types of drive waveform, depending on the selection made by the drive waveform selector unit 24. The drive waveforms generated by the drive waveform generator sections are described in the embodiments explained below.

(First Embodiment)

Figure 3A:
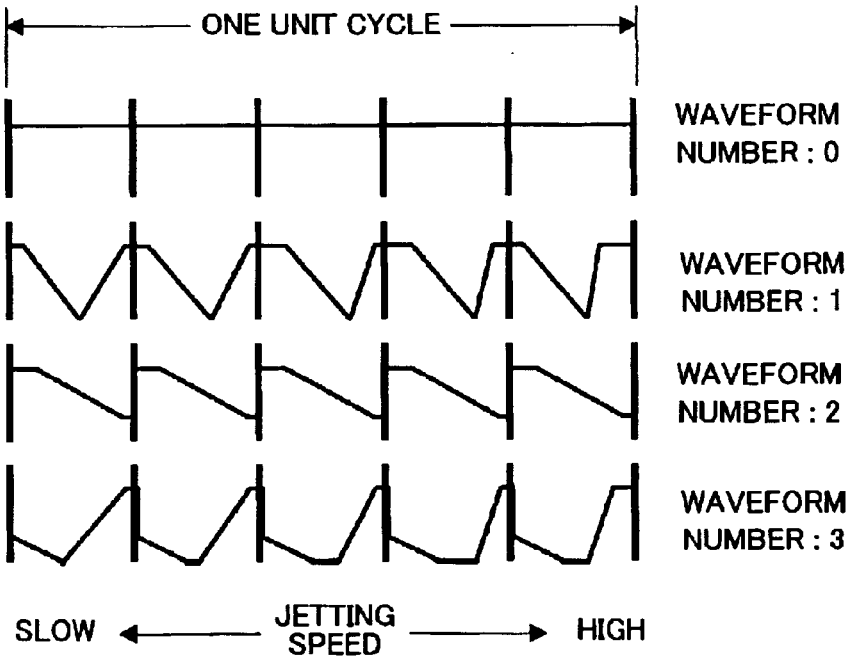
FIGS. 3(A), 3(B) and 3(*c*) are illustrative diagrams of drive waveforms according to a first embodiment of the present invention.
Figure 3B:
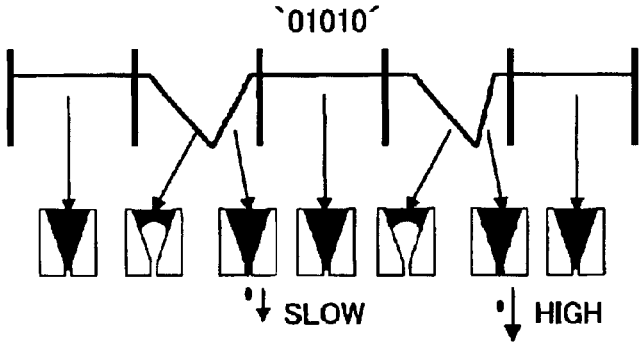
Figure 3C:
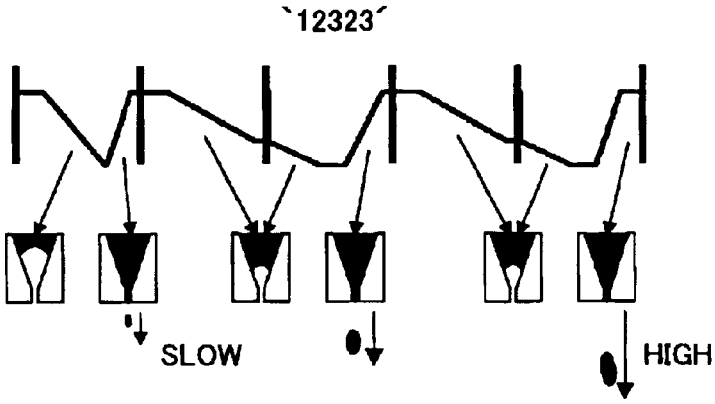
Figure 5A:
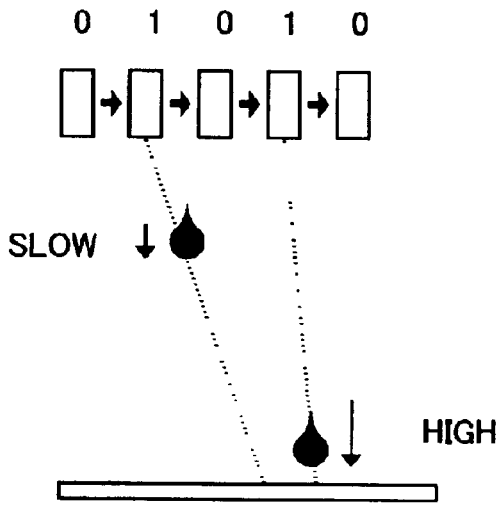
FIGS. 5(A) and 5(B) are illustrative diagrams of a concentrated mode according to a first embodiment of the present invention.
Figure 5B:
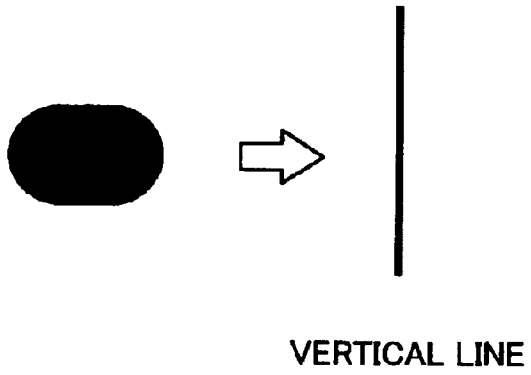
Figure 6:
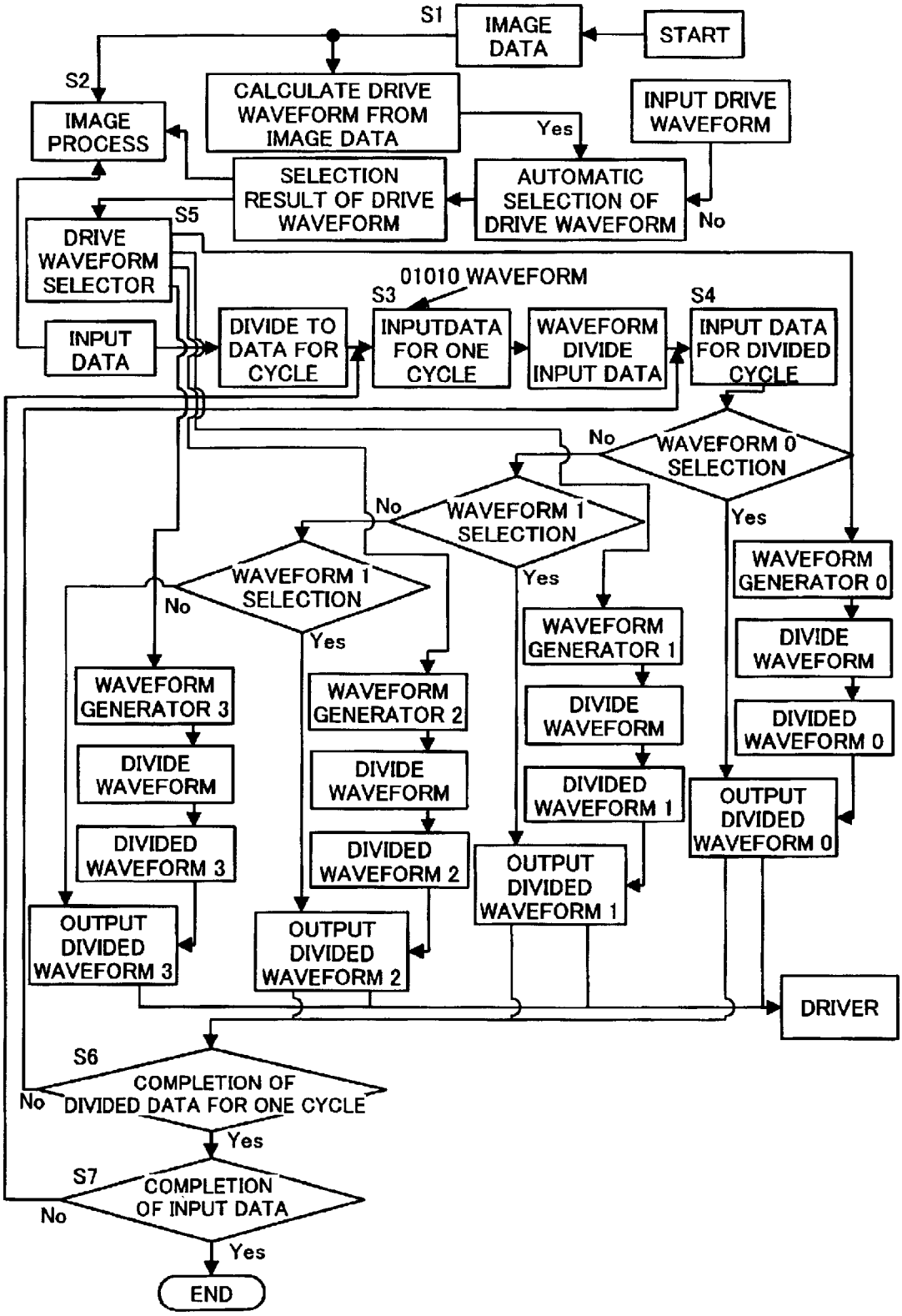
FIG. 6 is a flow diagram of drive waveform generation according to a first embodiment of the present invention.

FIG. 3 is an illustrative diagram of the drive waveform of a first embodiment of the present invention, FIG. 4 is an illustrative diagram of an ink jet operation in normal mode, FIG. 5 is an illustrative diagram of an ink jet operation in concentrated mode, and FIG. 6 is a flow diagram of drive waveform generation processing.

Figure 12:
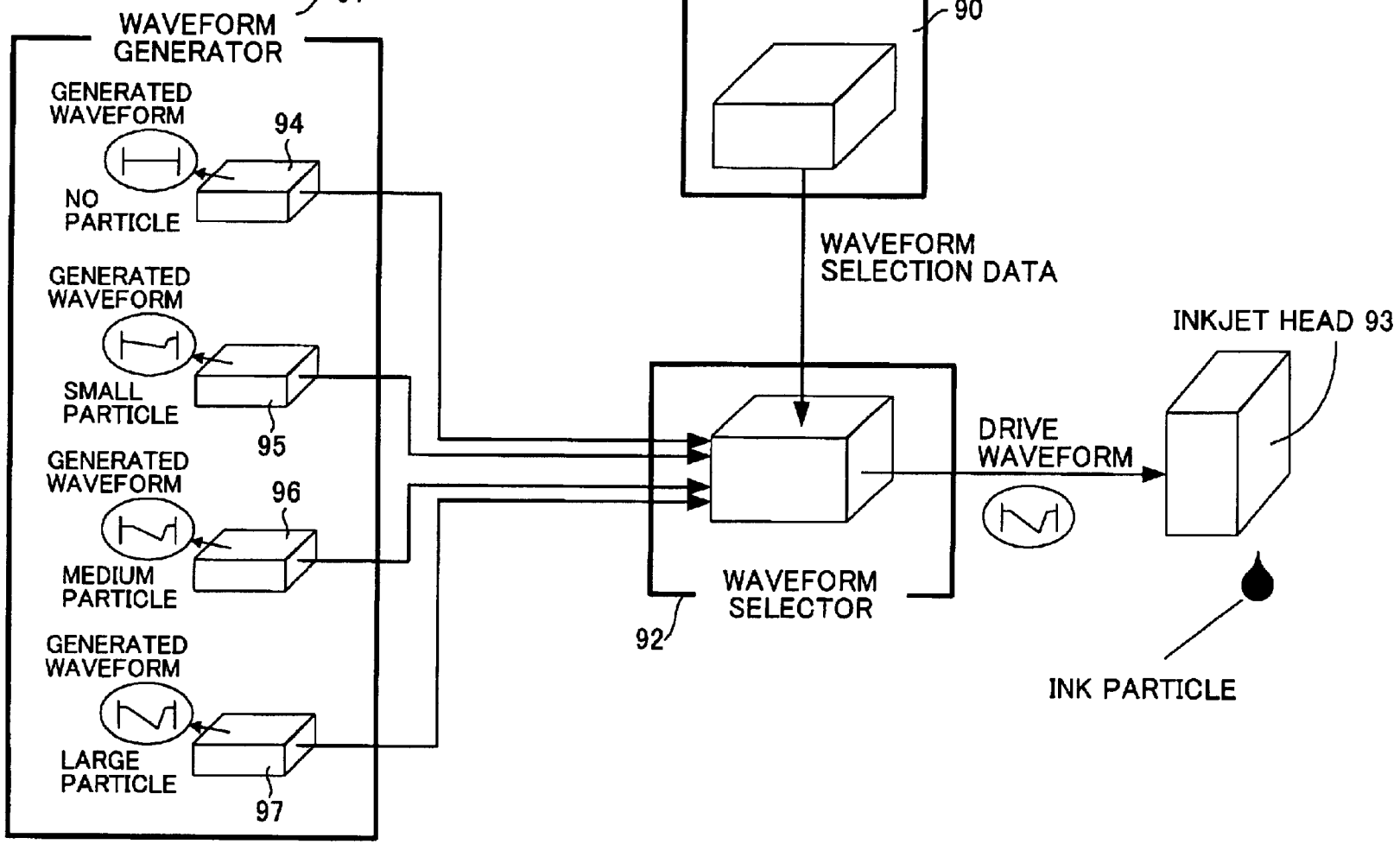
FIG. 12 PRIOR ART
FIG. 12 is an illustrative diagram of the prior art.

In FIG. 3, similarly to FIG. 12, the waveform of one cycle of the waveform generators 27–30 is divided into five parts, and the waveform generator 27 is caused to generate a waveform of waveform number '0' as illustrated in FIG. 12, the waveform generator 28 for generating a small particle waveform is caused to generate a waveform of waveform number '1', the waveform generator 29 for generating a medium particle waveform is caused to generate a waveform of waveform number '2', and the waveform generator 30 for generating a large particle waveform is caused to generate a waveform of waveform number '3'.

The waveform of waveform number '1' is a waveform for generating a micro-particle, in the waveform of one part of the divided time, and waveform numbers '2' and '3' are waveforms for generating a small particle in two parts of the divided time, by being selected sequentially. The waveforms being generated by the respective waveform generators in sequence from the left-hand side.

Moreover, within one cycle, at positions further towards the left-hand side in the diagram, the gradient of the waveform in the portion which causes ink to be injected lessens and the jetting speed reduces, whereas at positions further towards the right-hand side in the diagram, the gradient of the waveform in the portion which causes ink to be injected sharpens and the jetting speed becomes faster.

Figure 13A:
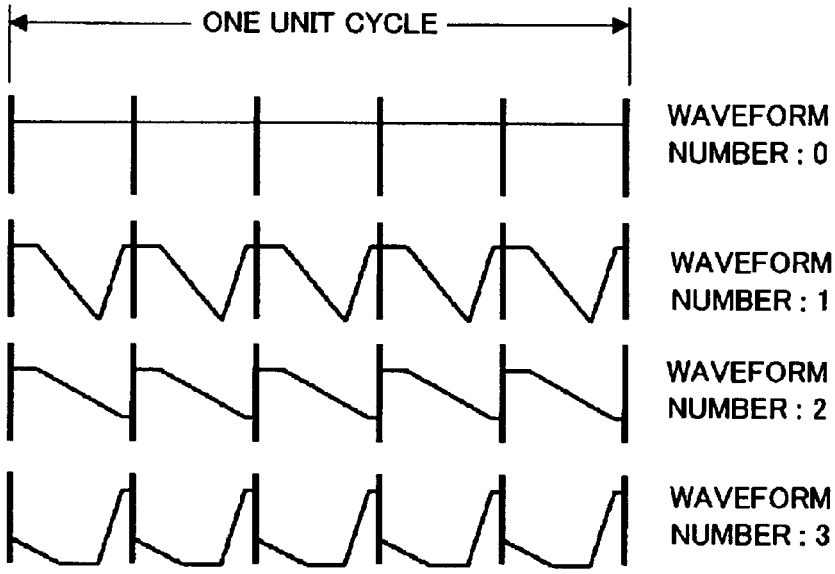
FIGS. 13(A), 13(B) and 13(C) are illustrative diagrams of a drive method according to the prior art.
Figure 13B:
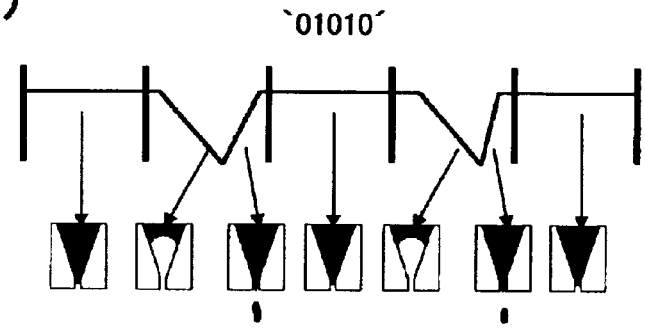

Thereby, in FIG. 3(B), inks are jetted by receiving the same waveform data as FIG. 13(B), but the speed of the particle on the left-hand side of FIG. 3(B) is slower, whereas the particle on the right-hand side is faster. Serial inkjet recording is performed whilst scanning the ink emission head as illustrated in FIG. 4(A) and FIG. 5(A).

Figure 4A:
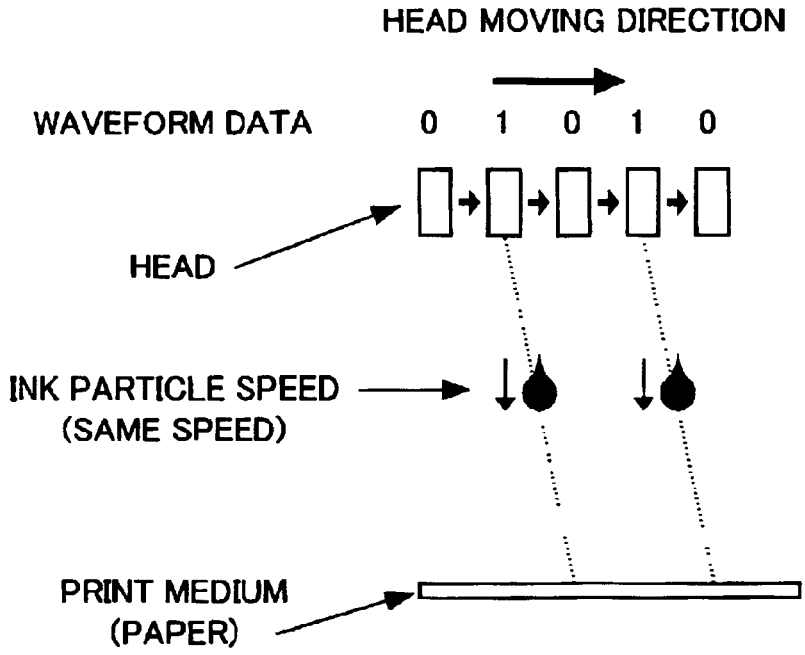
FIGS. 4(A) and 4(B) are illustrative diagrams of a normal mode according to a first embodiment of the present invention.
Figure 4B:
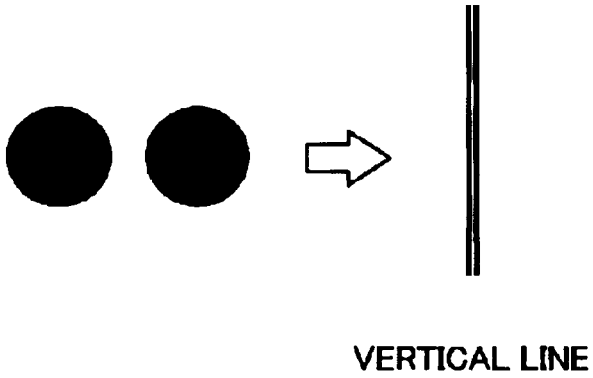

Here, considering a case where a thin vertical line is drawn, in the case of the waveform in FIG. 13(B), the ink particles fly in the directions illustrated in FIG. 4(A), and therefore, the small dots land a slight distance apart, as illustrated in FIG. 4(B), and hence a low density pattern is printed. However, in the case of the waveform in FIG. 3(B), the ink particles fly in the directions illustrated in FIG. 5(A), and hence the small dots overlap to form a single, thin vertical line, as illustrated in FIG. 5(B), thereby making it possible to obtain a sharp image.

Figure 13C:
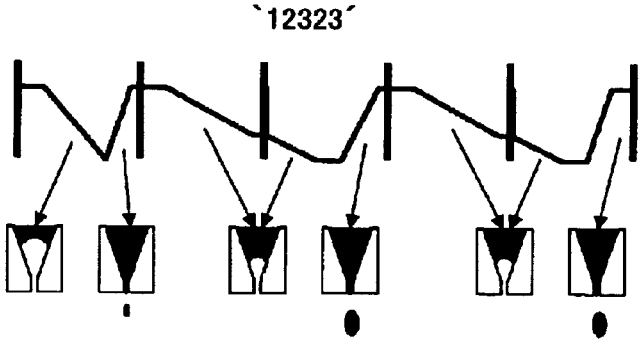

The printer is equipped with a print mode as illustrated in FIG. 4(A), FIG. 4(B) and FIG. 13 (herein called as standard print mode), and a print mode as in FIG. 3 (herein called as concentrated print mode). In other words, the waveform generator 25 in FIG. 2 is constituted in such a fashion that it can generate a drive waveform as in FIG. 13(A) (waveform numbers '0'–'3') and a drive waveform as in FIG. 3(A) (waveform numbers '0'–'3'). The controller 23 indicates standard printing or concentrated printing to the drive waveform selector unit 24, in accordance with a print mode instruction from an external source or a print mode obtained by analysing the image.

The drive waveform selector unit 24 instructs the respective generator sections 27–30 of the waveform generator 25 to generate waveforms for the indicated print mode. The respective waveform generator sections 27–30 generate a drive waveform for the indicated print mode. The waveform selector unit (head drive unit) 50 selects a drive waveform in accordance with the waveform selection data (print data) SDATA, and outputs it to the nozzle of the head 51.

Thereby, it is possible to select whether the dot distribution is to be standard or concentrated, depending on the print contents. For example, this is useful for achieving a sharp reproduction of a lines, and the like, in the case of a low resolution image. Moreover, since drive waveforms for standard and concentrated printing are provided, this can be achieved without changing the image data.

By constituting the waveform generator 25 by means of a memory, it is possible to generate the respective drive waveforms, readily. In other words, the waveform pattern for each waveform number are stored in the form of digital values, and the drive waveform selector unit 24 reads out the digital waveform data of the waveform number corresponding to the instructed memory address, and outputs this data to the waveform selector unit 50. The waveform selector unit 50 converts the waveform data selected according to the waveform selection data to an analogue drive waveform, which is output to the head 51.

The digital waveform pattern is stored as an absolute amplitude value for each time period. It may also be stored as a relative value with respect to a reference amplitude. For example, a subsequent waveform is represented as a relative value with respect to the last value of the preceding divided waveform. Furthermore, as shown in FIGS. 3(A), (B), (C), waveforms are used which have smooth joins between the divided waveform parts. Therefore, ink jet emission can be performed smoothly when the divided waveforms are combined.

FIG. 6 is a flow diagram of drive waveform generation processing, wherein the generation of drive waveforms to the aforementioned head is executed by means of a program.

(S1) The print mode (drive waveform) can be selected either by means of an external setting, or by automatic detection of the image processing. In automatic detection, the drive waveform is selected on the basis of the image data. For example, in the case of vector data, concentrated printing is selected since it involves lines, and the like, whereas in other cases, standard printing is selected.

(S2) The input image data is processed. For example, drawing processing is performed. The data is then sorted into data for respective cycles as described above. This data is, for example, 10-bit print data as described above.

(S3) The data for one cycle is read, and divided into separate data for respective divisions (2 bits).

(S4) The selected waveform for each separate data is determined.

(S5) A drive waveform '0'–'3' for the print mode selected at step (S1) is generated and the drive waveform determined at step (S4) is output.

(S6) It is determined whether or not the processing of each separate data in one cycle has been completed. If the processing has not yet completed, then the sequence returns to step (S4).

(S7) It is determined whether or not processing of the input data has been completed. If the processing has not yet completed, then the sequence returns to step (S3). If the processing has completed, then the sequence terminates.

In this embodiment, drive waveforms for a piezoelectric head are described, but it is also possible to apply drive waveforms for heads using a thermal element, and when the position at which the ink lands can be changed, then it is also possible to use variation in the amplitude, in addition to change in relative voltage change ratio as described above.

(Second Embodiment)

FIG. 7 is an illustrative diagram of drive waveforms according to a second embodiment, FIG. 8 is an illustrative diagram of an ink emission operation in normal mode, and FIG. 9 is an illustrative diagram of an ink emission operation in disperse mode.

Figure 7A:
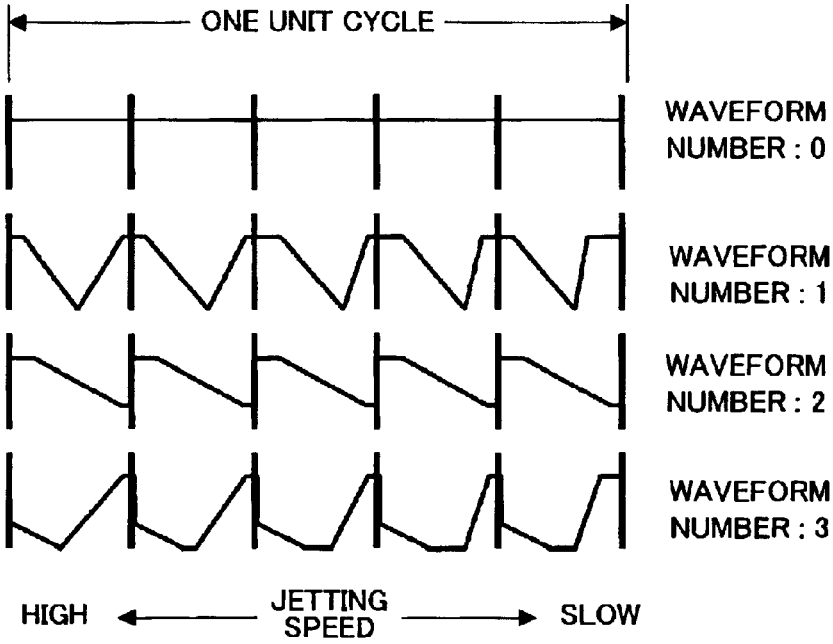
FIGS. 7(A) and 7(B) are illustrative diagrams of drive waveforms according to a second embodiment of the present invention.
Figure 8A:
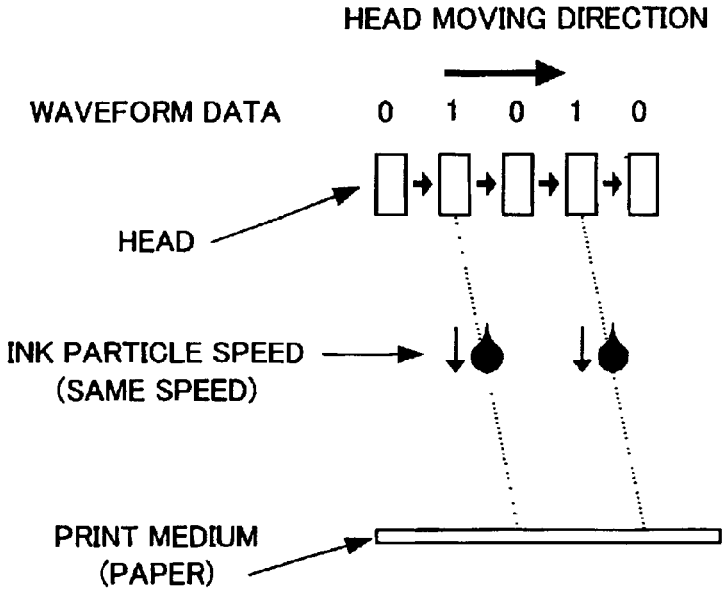
FIGS. 8(A), 8(B) and 8(C) are illustrative diagrams of a normal mode according to a second embodiment of the present invention.

As illustrated in FIG. 7(A), the waveform for a single cycle of the waveform generator is divided into five parts, as in FIG. 13(A) and FIG. 3(A). A waveform generator 27 for generating a no particle waveform is caused to generate waveform of waveform number '0', a waveform generator 28 for generating a small particle waveform is caused to generate a waveform of waveform number '1', a waveform generator 29 for generating a medium particle waveform is caused to generate a waveform of waveform number '2', and a waveform generator 30 for generating a large particle waveform is caused to generate a waveform of waveform number '3'.

Here, the waveform of waveform number '1' is a waveform for generating a micro-particle by a waveform of one part of the divided time period, and the waveform numbers '2', '3' are waveforms for generating a small particle in two parts of the divided time period, by being selected sequentially. The waveforms are generated by each respective waveform generator in sequence from the left-hand side in the diagram.

Moreover, within one cycle, at positions further towards the left-hand side in the diagram, the gradient of the waveform in the portion which causes ink to be injected sharpens and the jetting speed increases, whereas at positions further towards the right-hand side in the diagram, the gradient of the waveform in the portion which causes ink to be injected lessens and the jetting speed becomes slower.

Figure 7B:
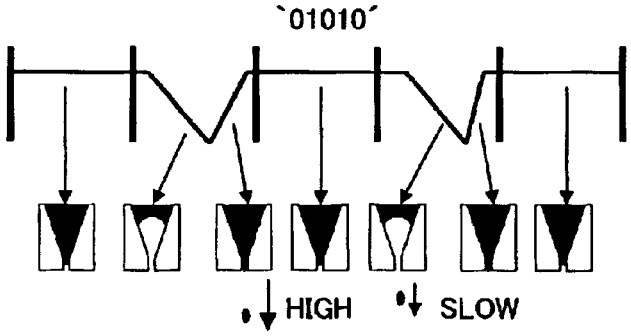
Figure 8B:
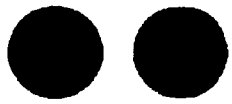
Figure 8C:
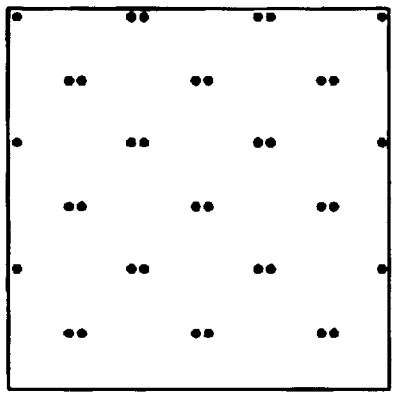

Thereby, in FIG. 7(B), inks are jetted by receiving the same waveform data as FIG. 13(B), but the speed of the particle on the left-hand side of FIG. 7(B) is faster, whereas the particle on the right-hand side is slower. Serial inkjet recording is performed whilst scanning the ink emission head as described above. Therefore, in a case where a thin vertical line is drawn, in the case of the waveform in FIG. 13(B), the ink particles fly in the directions illustrated in FIG. 8(A), and therefore, the small dots land a slight distance apart, as illustrated in FIG. 8(B), and hence a low density pattern is printed. Therefore, a printing result of high granularity is obtained, as shown in FIG. 8(C).

Figure 9A:
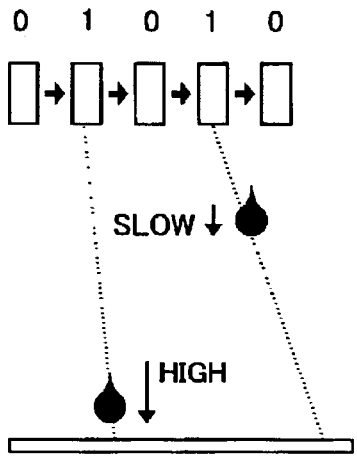
FIGS. 9(A), 9(B) and 9(C) are illustrative diagrams of a dispersed mode according to a second embodiment of the present invention.
Figure 9B:
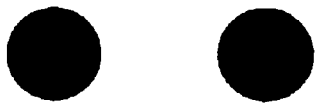
Figure 9C:
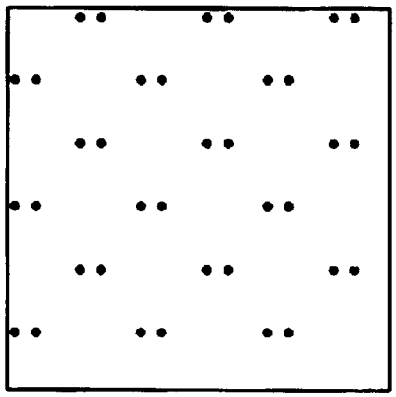

However, in the case of the waveform in FIG. 7(B), the ink particles fly in the directions illustrated in FIG. 9(A), and hence the small dots land a large distance apart, as shown in FIG. 9(B), thereby printing a low density. Consequently, a soft image of enhanced granularity can be obtained, as shown in FIG. 9(C).

In this example, the printer has a standard print mode and disperse print mode, which can be selected by setting or automatically. Moreover, these modes can be achieved by means of the same composition.

(Third Embodiment)

Figure 10:
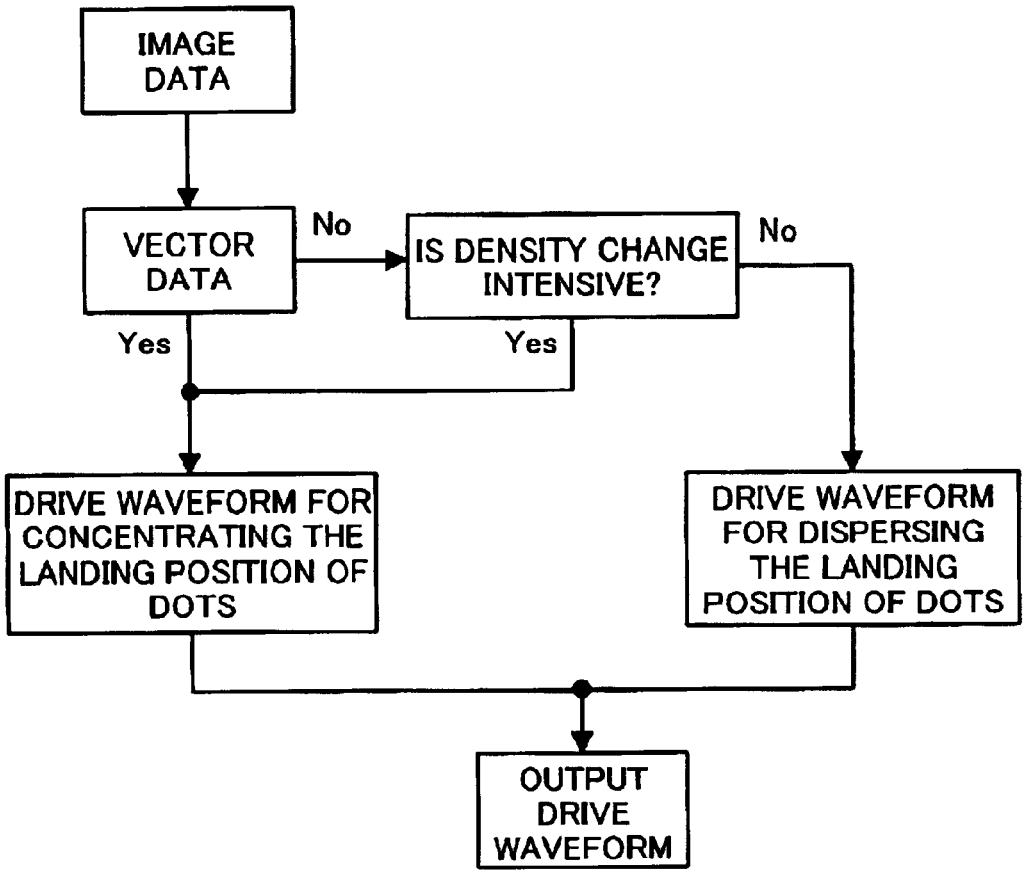
FIG. 10 is a flow diagram of print mode selection according to a third embodiment of the present invention.

FIG. 10 is an illustrative diagram of drive waveform selection processing according to a third embodiment of the present invention. In this example, the printer has a concentrated print mode as in FIG. 3, and a disperse print mode as in FIG. 7.

The concentrated print mode and disperse print mode are switched according to the image data and the environment of the ink. In other words, if the image data is vector data, then as described above, the concentrated print mode is selected in order to print vertical lines clearly. If there is sudden temperature change in the device, then the amount of ink injected reduces due to change in the viscosity of the ink, and therefore the concentrated print mode is selected. In other cases, the disperse print mode is selected. In this way, a mode which does not use a standard mode can be adopted.

(Fourth Embodiment)

Figure 11A:
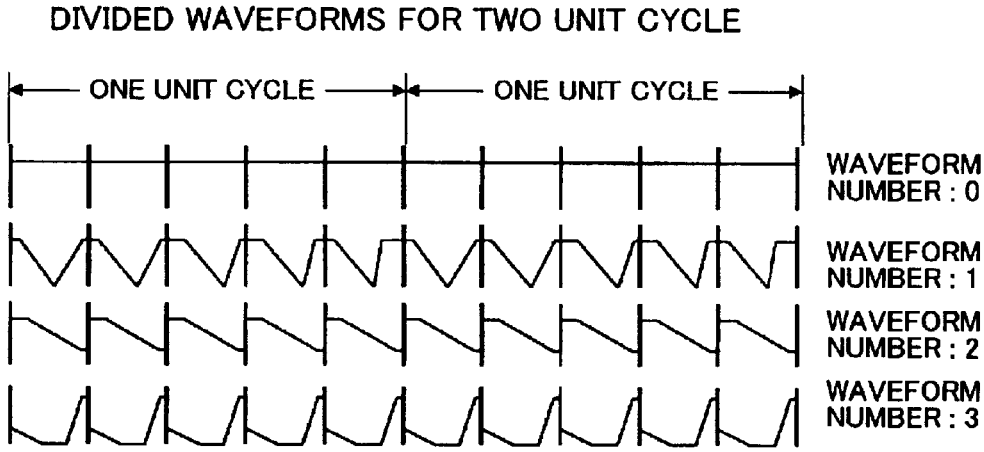
FIGS. 11(A), 11(B) and 11(C) are illustrative diagrams of drive waveforms according to a fourth embodiment of the present invention.

FIG. 11 is an illustrative diagram of drive waveforms according to a fourth embodiment of the present invention. This example describes a case where the first embodiment in FIG. 3(A) is applied to a horizontal line. As shown in FIG. 11(A), the waveform for one cycle of the waveform generator is divided into five parts in a similar way to FIG. 3(A). A waveform generator 27 for generating a no particle waveform is caused to generate a waveform of waveform number '0', a waveform generator 28 for generating a small particle is caused to generate a waveform of waveform number '1', a waveform generator 29 for generating a medium particle waveform is caused to generate a waveform of waveform number '2', and a waveform generator 30 for generating a large particle waveform is caused to generate a waveform of waveform number '3'.

Here, similarly to FIG. 3(A), the waveform of waveform number '1' is a waveform generating a micro-particle by the waveform of one part of the divided time period, and within one cycle, at positions further towards the left-hand side in the diagram, the gradient of the waveform in the portion which causes ink to be injected lessens and the emission speed reduces. Moreover, waveform numbers '2' and '3' are waveforms generating a small particle in two parts of the divided time period, by being selected sequentially, and the emission speeds of these small particles is uniform.

The waveforms are generated by the respective waveform generators, in sequence from the left-hand side, and FIG. 11(A) shows a chart of the waveforms for two cycles. A case was investigated wherein a straight line was drawn extending in the scanning direction and requiring a maximum particle size.

Figure 11B:
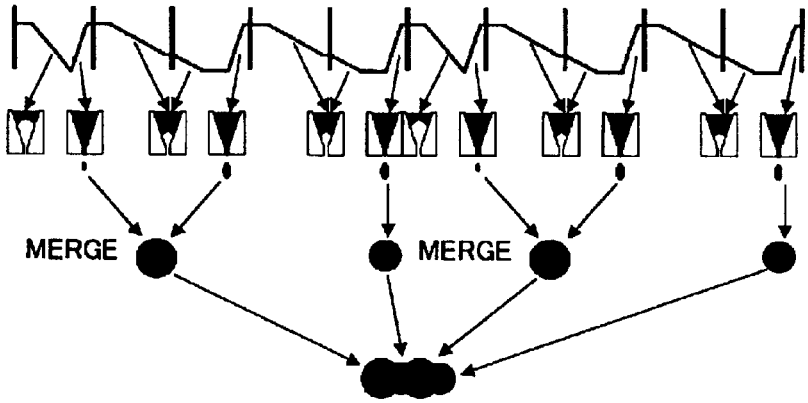

In FIG. 11(B), when the waveform '12323' for forming a maximum particle size is selected as a waveform of the prior art illustrated in FIG. 13(B), the emission speed of the first micro-particle is slow, and therefore it merges with the following small particle to form a large particle, and hence a large dot is generated. The following small particle forms a small dot. Thereby, an undulating straight line is formed as illustrated in FIG. 11(B) by alternating deposition of large dots and small dots.

Figure 11C:
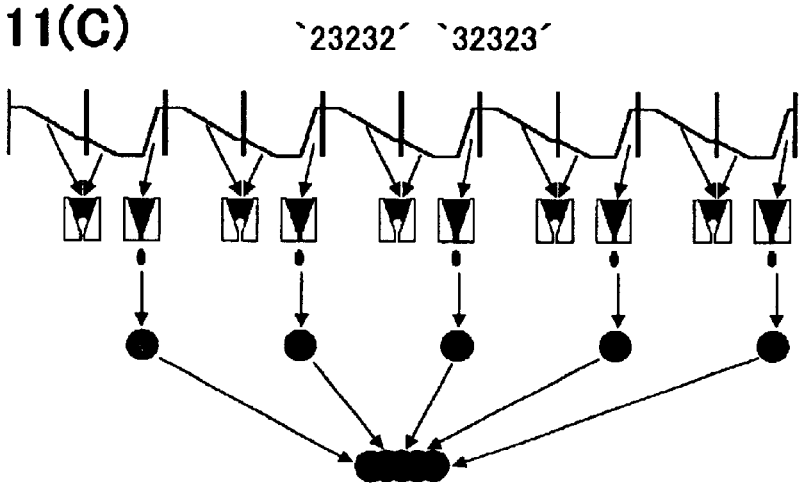

However, in this embodiment, as illustrated in FIG. 11(C), the waveforms of divisions located at the boundary between two cycles are formed so as to extend over the two cycles, in other words, a '23232' waveform and '32323' waveform are supplied and a straight line can be formed by means of small dots only. Therefore, a clean straight line without any undulations can be formed.

Above, the present invention was described by means of embodiments, but various modifications may be implemented within the scope of the essence of the invention, and such modifications are not excluded from the scope of the present invention.

INDUSTRIAL APPLICABILITY

By varying the speed of ink particles injected within one cycle of a drive waveform, the landing position of each dot within a cycle is controlled and the dot pattern within a cycle is varied. Since this is achieved by means of the drive waveform, it can be implemented without changing the image data. Therefore, in particular when printing images by low-resolution surface area gradation, it is possible to obtain a sharper image by concentrating the landing positions of the dots and raising the resolution, when an image of sharp variation in density is required, and furthermore, it is possible to obtain a smoother image by causing the landing positions of the dots to be more disperse, when an image of smoother variation in density such as photograph, is required.

What is claimed is:

1. An inkjet printer, comprising:

an inkjet head which performs recording by moving in a main scanning direction of a recording medium and jetting ink particles;

a drive waveform generating unit for generating drive waveforms for jetting said ink particles; and a head drive unit for selecting said drive waveforms and driving said inkjet head, in accordance with print data, wherein said drive waveform generating unit generates a drive waveform for jetting a plural ink particles having respectively different ink speeds within a unit cycle, said one ink particle is jetted in cycles each corresponding to one of the parts obtained by dividing the unit cycle by an integer, and wherein said plural ink particles each arrive separately on said recording medium.

2. The inkjet printer according to claim 1, wherein said drive waveform generating unit generates a plurality of drive waveforms for jetting said ink particles of respectively different ink speeds within said unit cycle, in order to achieve different ink particle volumes.

3. The inkjet printer according to claim 1, wherein said drive waveform generating unit selectively generates said drive waveform and a second drive waveform for jetting said ink particles having the same ink speed, within said unit cycle.

4. The inkjet printer according to claim 3, wherein further comprising a control unit for controlling the generation of said second drive waveform and the generation of said drive waveform by said drive waveform generating unit, in accordance with instructions from an external source or analysis of said print data.

5. The inkjet printer according to claim 1, wherein said drive waveform generating unit generates drive waveforms of different waveform shapes, within said unit cycle.

6. The inkjet printer according to claim 5, wherein said drive waveform generating unit generates drive waveforms having different relative voltage changes, within said unit cycle.

7. The inkjet printer according to claim 1, wherein said drive waveform generating unit generates drive waveforms for concentrating the landing positions of said plurality of injected ink particles, within said unit cycle.

8. An inkjet printer comprising:

an inkjet head which performs recording by moving in a main scanning direction of a recording medium and letting ink particles;

a drive waveform generating unit for generating drive waveforms for letting said ink particles; and a head drive unit for selecting said drive waveforms and driving said inkjet head, in accordance with print data, wherein said drive waveform generating unit generates a drive waveform for jetting a plural ink particles having respectively different ink speeds within a unit cycle, said one ink particle is jetted in cycles each corresponding to one of the parts obtained by dividing the unit cycle by an integer, wherein said plural ink particles each arrive separately on said recording medium, and wherein said drive waveform generating unit generates drive waveforms for dispersing the landing positions of said plurality of injected ink particles, within said unit cycle.

9. A drive method for an inkjet head which performs recording by moving in a main scanning direction of a recording medium and jetting ink particles, comprising the steps of:

generating drive waveforms for jetting said ink particles of respectively different ink speeds within said unit cycle, said one ink particle is jetted in cycles each corresponding to one of the parts obtained by dividing the unit cycle by an integer; and selecting said drive waveform in accordance with print data and driving said inkjet head by said selected drive waveform, wherein said plural ink particles each arrive separately on said recording medium.

10. The drive method for an inkjet head according to claim 9, wherein said step of generating drive waveforms, comprises a step of generating a plurality of drive waveforms for jetting said ink particles of respectively different ink speeds, within said unit cycle, in order to achieve different ink particle volumes.

11. The drive method for an inkjet head according to claim 9, wherein said step of generating drive waveforms, comprises a step of generating selectively said drive waveform and a second waveform for jetting said ink particles having the same ink speed, within said unit cycle.

12. The drive method for an inkjet head according to claim 11, further comprising a step of controlling the generation of said second drive waveform and the generation of said drive waveform in said drive waveform generating step, in accordance with instructions from an external source or analysis of said print data.

13. The drive method for an inkjet head according to claim 9, wherein said drive waveform generating step comprises a step of generating drive waveforms of different waveform shapes within said unit cycle.

14. The drive method for an inkjet head according to claim 13, wherein said drive waveform generating step comprises a step of generating drive waveforms having different relative voltage changes within said unit cycle.

15. The drive method for an inkjet head according to claim 9, wherein said drive waveform generating step comprises a step of generating drive waveforms for concentrating the landing positions of said plurality of jetted ink particles within said unit cycle.

16. A drive method for an inkjet head which performs recording by moving in a main scanning direction of a recording medium and jetting ink particles, comprising the steps of:

generating drive waveforms for jetting said ink particles of respectively different ink speeds within said unit cycle, said one ink particle is jetted in cycles each corresponding to one of the parts obtained by dividing the unit cycle by an integer; and selecting said drive waveform in accordance with print data and driving said inkjet head by said selected drive waveform, wherein said plural ink particles each arrive separately on said recording medium, and wherein said step of generating drive waveforms comprises a step of generating drive waveforms for dispersing the landing positions of said plurality of jetted ink particles within said unit cycle.

17. A drive device for an inkjet head which performs recording by moving in a main scanning direction of a recording medium and jetting ink particles, comprising:

a drive waveform generating unit for generating drive waveforms for jetting said ink particles; and a head drive unit for selecting said drive waveforms in accordance with print data and driving said inkjet head by said selected drive waveforms, wherein said drive waveform generating unit generates a drive waveform for jetting ink particles having respectively different ink speeds within a unit cycle, said one ink particle is jetted in cycles each corresponding to one of the parts obtained by dividing the unit cycle by an integer, and wherein said plural ink particles each arrive separately on said recording medium.

18. The drive device for an inkjet head according to claim 17, wherein said drive waveform generating unit generates a plurality of drive waveforms for jetting said ink particles of respectively different ink speeds within said unit cycle, in order to achieve different ink particle volumes.

19. The drive device for an inkjet head according to claim 17, wherein said drive waveform generating unit selectively generates said drive waveform and a second drive waveform for jetting said ink particles having the same ink speed, within said unit cycle.

20. The drive device for an inkjet head according to claim 19, further comprising a control unit for controlling the generation of said second drive waveform and the generation of said drive waveform by said drive waveform generating section, in accordance with instructions from an external source or analysis of said print data.

21. The drive device for an inkjet head according to claim 17, wherein said drive waveform generating unit generates drive waveforms of different waveform shapes, within said unit cycle.

22. The drive device for an inkjet head according to claim 21, wherein said drive waveform generating unit generates drive waveforms having different relative voltage changes, within said unit cycle.

23. The drive device for an inkjet head according to claim 17, wherein said drive waveform generating unit generates drive waveforms for concentrating the landing positions of said plurality of jetted ink particles, within said unit cycle.

24. A drive device for an inkjet head which performs recording by moving in a main scanning direction of a recording medium and jetting ink particles, comprising:

a drive waveform generating unit for generating drive waveforms for jetting said ink particles; and a head drive unit for selecting said drive waveforms in accordance with print data and driving said inkjet head by said selected drive waveforms, wherein said drive waveform generating unit generates a drive waveform for jetting ink particles having respectively different ink speeds within a unit cycle, said one ink particle is jetted in cycles each corresponding to one of the parts obtained by dividing the unit cycle by an integer, wherein said plural ink particles each arrive separately on said recording medium, and wherein said drive waveform generating unit generates drive waveforms for dispersing the landing positions of said plurality of jetted ink particles, within said unit cycle.

* * * * *